US008525685B2

(12) United States Patent
Knotts

(10) Patent No.: US 8,525,685 B2
(45) Date of Patent: Sep. 3, 2013

(54) APPARATUS AND METHOD FOR SELECTIVELY DRIVING A PIEZO TRANSDUCER

(75) Inventor: Thomas Allen Knotts, Mountain View, CA (US)

(73) Assignee: Medsolve Technologies, Inc., Manhattan Beach, CA (US)

( * ) Notice: Subject to any disclaimer, the term of this patent is extended or adjusted under 35 U.S.C. 154(b) by 660 days.

(21) Appl. No.: 12/788,500

(22) Filed: May 27, 2010

(65) Prior Publication Data

US 2010/0259402 A1 Oct. 14, 2010

Related U.S. Application Data

(63) Continuation of application No. PCT/US2008/085024, filed on Nov. 26, 2008.

(60) Provisional application No. 60/991,145, filed on Nov. 29, 2007.

(51) Int. Cl.
*G08B 21/00* (2006.01)

(52) U.S. Cl.
USPC ..... 340/665; 73/760

(58) Field of Classification Search
USPC ..... 340/540, 665; 73/760, 768, 862.381, 73/862.391
See application file for complete search history.

(56) References Cited

U.S. PATENT DOCUMENTS

| | | | | |
|---|---|---|---|---|
| 5,243,327 | A * | 9/1993 | Bentz et al. | 340/566 |
| 5,304,206 | A * | 4/1994 | Baker et al. | 607/2 |
| 6,354,299 | B1 * | 3/2002 | Fischell et al. | 128/899 |
| 2002/0118605 | A1 * | 8/2002 | Born et al. | 368/69 |

* cited by examiner

*Primary Examiner* — George Bugg
*Assistant Examiner* — Edny Labbees
(74) *Attorney, Agent, or Firm* — Novak Druce Connolly Bove + Quigg LLP

(57) ABSTRACT

Devices and methods are provided for selectively driving a piezo transducer to operate as a pressure pattern detector or an alarm generator. In one embodiment, there is provided a device that includes: a piezo transducer; a comparator coupled to the transducer and a reference voltage; and a pressure pattern recognition circuit coupled to a comparator output of the comparator. The pressure pattern recognition circuit may be configured to: (i) determine whether the pressure pattern satisfies a predetermined condition; and (ii) in response to the pressure pattern satisfying the predetermined condition, generate an output signal.

5 Claims, 4 Drawing Sheets

APPARATUS AND METHOD FOR SELECTIVELY DRIVING A PIEZO TRANSDUCER

CROSS-REFERENCE TO RELATED APPLICATION(S)

This application is a continuation of PCT/US2008/085024, filed Nov. 26, 2008, which claims priority to U.S. Provisional Application Ser. No. 60/991,145 filed Nov. 29, 2007, the disclosures of which are incorporated herein by reference.

BACKGROUND OF THE INVENTION

1. Field of the Invention

The present application relates generally to infusion pumps for the delivery of therapeutic or diagnostic agents, and more specifically to techniques for selectively driving a piezo transducer to operate as a pressure pattern detector or an alarm generator.

2. Description of the Related Art

Some medical procedures and devices employ the infusion of therapeutic agents into living bodies over periods of time, and such procedures and devices have been used for the infusion of insulin or the like. One example of a device for the infusion of therapeutic or diagnostic agents being developed is an infusion pump. Development of such pumps and related components are part of an ongoing effort to improve techniques for infusing agents, such as, for example, those techniques and approaches described in U.S. patent application Ser. No. 11/548,238, filed Oct. 10, 2006, entitled "METHOD AND APPARATUS FOR INFUSING LIQUID TO A BODY."

A given system for infusing agents may include multiple components, such as, for example, an infusion pump in operative communication with an external controller. Sometimes, however, the infusion pump may become separated from or otherwise not able to communicate with the external controller. For this and other scenarios, it would be desirable to provide a user with the option of controlling the pump via a manual input, such as, for example, a touch sensor. Such a manual input may include a piezo transducer. Accordingly, it would also be desirable to adapt the transducer to perform a function other than operating as a touch sensor, such as, for example, generating an alarm signal or the like.

SUMMARY OF THE INVENTION

Before proceeding to the detailed description of embodiments of the invention, a brief summary of the invention is provided as follows. The present invention relates to electrical circuits for controlling a piezo transducer in an infusion pump or other similar device. It is important in certain situations for the pump to give the user the option of manually controlling or overriding features of the pump, such as, for example, to deliver a dose of insulin when the user's blood sugar is or will become highly elevated. The electrical circuitry of the pump preferably responds to defined pressure patterns detected by the transducer, so as to avoid unnecessarily placing the pump in manual mode. The electrical circuitry of the pump also preferably drives the transducer to generate alarm signals (e.g., audible alarms) in response to certain triggering events (e.g., when no pumping is occurring).

The present invention provides an apparatus/circuit for controlling a device having a touch sensor. The apparatus may comprise a piezo transducer for detecting a pressure pattern applied to the sensor; a comparator coupled to the transducer and a reference voltage; and a pressure pattern recognition circuit coupled to a comparator output of the comparator. The pressure pattern recognition circuit may be configured to: (i) determine whether the pressure pattern satisfies a predetermined condition; and (ii) in response to the pressure pattern satisfying the predetermined condition, generate an output signal.

In a related aspect of the present invention, the pressure pattern recognition circuit may be configured to recognize and respond to N taps occurring in succession. For example, the circuit may be configured to: (a) detect a rising edge on a comparator output signal; (b) in response to detecting the rising the edge, determine whether a time period elapsed since a previously detected edge falls within minimum and maximum time limits; (c) in response to the elapsed time falling within the minimum and maximum time limits, (i) increase a tap count and (ii) wait a debounce time period; and (d) in response to the tap count equaling N, waking up a component the apparatus.

In another related aspect of the present invention, the pressure pattern recognition circuit may be further configured to: (e) in response to the elapsed time falling outside the minimum and maximum time limits, set the tap count to zero; (f) detect a subsequent rising edge on the comparator output signal; and (g) in response to detecting the subsequent rising the edge, (i) increase the tap count, (ii) wait the debounce time period, and (iii) return to step (a).

In another related aspect of the present invention, the apparatus may further comprise a switch coupled to and selectively connecting the transducer to one of (i) a logic circuit and (ii) an oscillator. The transducer may operate as a pressure pattern detector in response to being connected to the logic circuit or as an alarm generator in response to being connected to the oscillator.

In another related aspect of the present invention, (i) the logic circuit may provide a signal value corresponding to a logic value, thereby grounding a bottom lead of the transducer, or (ii) the oscillator provides an oscillating signal, thereby increasing a drive voltage to the transducer.

In another related aspect of the present invention, an inverter may connected between the switch and a bottom lead of the transducer, wherein the inverter is configured to transmit a ground signal to the transducer to permit the transducer to operate as the pressure pattern detector, and wherein the inverter is configured to transmit an oscillating signal to the transducer to permit the transducer to operate as the alarm generator.

In another related aspect of the present invention, the apparatus may further comprise a tri-state buffer coupled to a top lead of the transducer. In response to the buffer being set to a high impedance state, the transducer is permitted to operate as the pressure pattern detector. In response to the buffer being set to a low impedance state, the transducer is permitted to operate as the alarm generator. The oscillator may drive the top and bottom leads of the transducer with opposite phases, thereby doubling an effective drive of the transducer.

In yet another related aspect of the present invention, there is provided a method for controlling a device having a touch sensor. The method may involve: sensing a pressure pattern applied to a sensor; and determining whether the pressure pattern satisfies a predetermined condition. The method may further involve, in response to the pressure pattern satisfying the predetermined condition, generating an output signal; and controlling the device via the output signal. The method may further involve generating an alarm based on the output signal, wherein the alarm is generated using a transducer coupled to the sensor.

To the accomplishment of the foregoing and related ends, the one or more embodiments comprise the features hereinafter fully described and particularly pointed out in the claims. The following description and the annexed drawings set forth in detail certain illustrative aspects of the one or more embodiments. These aspects are indicative, however, of but a few of the various ways in which the principles of various embodiments may be employed and the described embodiments are intended to include all such aspects and their equivalents.

DETAILED DESCRIPTION

Figure 1:
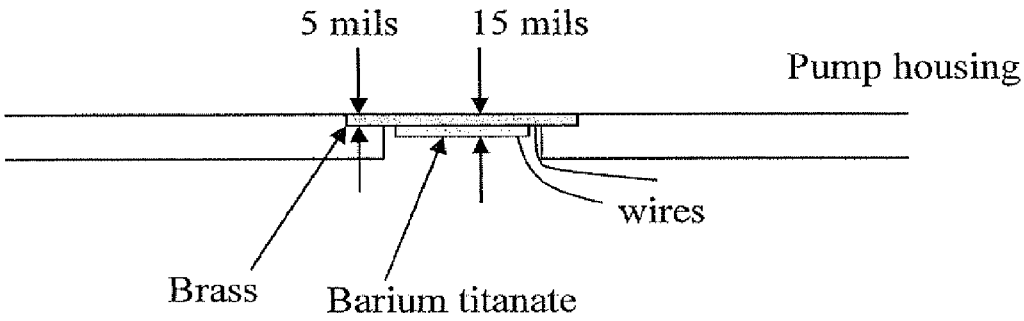
FIG. 1 illustrates an exemplary hermetically sealed placement of a piezo disk to pump housing.

Various embodiments are now described with reference to the drawings, wherein like reference numerals are used to refer to like elements throughout. In the following description, for purposes of explanation, numerous specific details are set forth in order to provide a thorough understanding of one or more embodiments. It may be evident, however, that such embodiment(s) can be practiced without these specific details. In other instances, well-known structures and devices are shown in block diagram form in order to facilitate describing one or more embodiments.

In accordance with one or more embodiments and corresponding disclosure thereof, various aspects are described in connection with a system comprising an infusion pump and an external controller. The infusion pump and the external controller may communicate with each other via a radio link or the like. Due to the power drain of the radio on the pump battery, the communication may take place for very short bursts occurring at regular intervals, such as, for example, 10 minute intervals. The selected frequency of data exchange should be adequate for normal operation of the infusion pump.

Occasionally, one may wish to connect to the pump immediately without waiting for the next scheduled connection time. For example, if one began eating and then realized he or she forgot to enter a bolus, then he or she might want the increased infusion to begin immediately and not wait for up to 10 minutes before the controller communicated this to the pump. In another example, a technician may want to establish an immediate connection to the pump when doing analysis or debugging. To accommodate these and other scenarios, a manual means is preferably supplied or provided to turn on or "wake up" the radio at an unscheduled time.

In one example, wherein the external controller comprises a personal digital assistant (PDA), smart phone, mobile phone, or other similar portable device, another use of an external signal to the pump may be for the initial pairing between pump and PDA after the pump has been mated with a newly refilled disposable and attached to the body. One could initiate a pairing command on the PDA, then manually wake up the pump. The pump would turn its radio on, connect to (i.e., communicate with) the PDA to receive the initial pump schedules, and time synchronize to the PDA. Initial time synchronization may be critical if the two devices are to successfully connect at regularly scheduled intervals.

Another use for the embodiments described herein may be to signal the pump to suspend all pumping until it receives another signal to resume the flow. Yet another use for the invention would be to signal the pump to go into manual mode, and then each time the user signals it again, a pump cycle could be induced. This manual mode would be useful for example if the PDA were unavailable due to battery or other failure, or if it were lost or stolen.

A simple approach for manual signaling would be to place a pushbutton switch on the pump. This has several issues. First, the button should be kept extremely short to meet the pump height design goals. Second, a hermetic seal around the switch may be required. Third, the switch should be easy to operate. Finally, the switch must be immune to inadvertent activation due to the pressure of clothing, or the user leaning against an object; the unintentional activations would drain the battery needlessly. These issues are addressed with the embodiments of the apparatuses and methods described herein.

With reference to the embodiment of FIG. 1, the first three issues listed in the previous paragraph may be solved by using a piezo transducer disk 110, such as, for example, the G2602 from Murata, or the like. The disk 110 may have a diameter of about ¾ to about 1 inch, and are about 5 mils (i.e., 5 thousandths of an inch) thick around the edge, and about 15 mils at the center. With this structure, disk 110 can be attached to the pump housing 100 with a hermetic seal, as shown in FIG. 1.

The disk 110 may include a brass plate 112 coupled to a barium nitrate portion 114. The disk 110 may further include wires 116 and 118 coupled to the brass plate 112 and the barium nitrate portion, respectively. When pressure is applied to the brass plate 112, the brass 112 flexes slightly and a voltage is generated across the wires 116, 118. This approach has a low profile, can be hermetically sealed (and the brass 112 may additionally provide EMI shielding) and the brass plate 112 is large enough for the user to easily locate and press with his/her finger.

Figure 2:
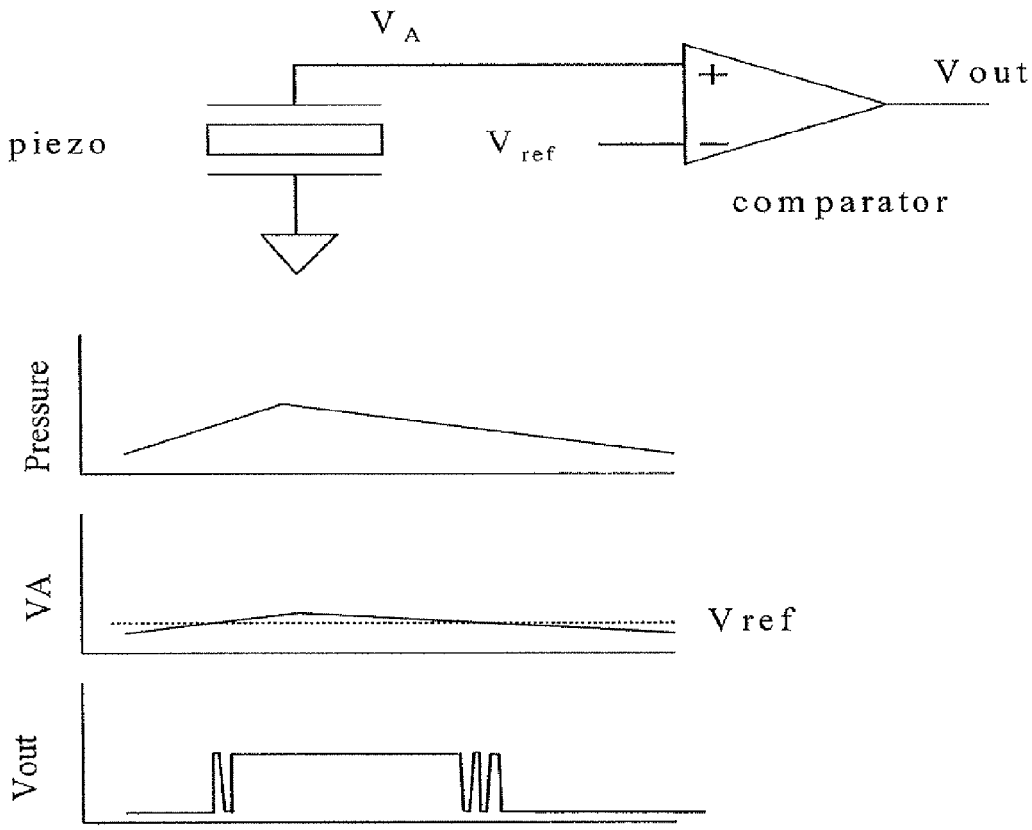
FIG. 2 shows an exemplary circuit for sensing pressure applied to a piezo actuator and typical associated waveforms.

In accordance with one aspect of the embodiment described herein, the voltage from the piezo transducer disk 110 or the like may be sensed with the exemplary circuit shown in FIG. 2. The output voltage Vout is shown with chatter that may be created as the input voltage VA slowly moves across the threshold voltage Vref due to noise.

Because this disk can be easily pressed by clothing, or one leaning against an object, the comparator output Vout will likely activate from time to time without an intentional application of pressure. To prevent this from activating the radio, a circuit may be used to process the voltage Vref, such that the radio is only activated when a specific pattern is observed, one that will not likely occur when unintentional pressure is applied. There are many possible patterns that can be used. One simple and easy-to-apply pattern is a train of pulses that would occur if one simply taps repeatedly on the disk with one's finger.

Figure 3:
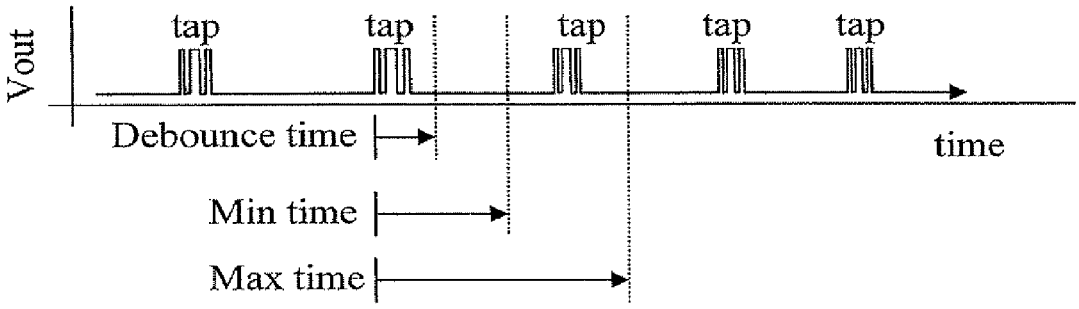
FIG. 3 illustrates an exemplary comparator output when a piezo disk is repeatedly tapped.

For example, a dedicated circuit and/or microcontroller algorithm can be designed to recognize N taps occurring in succession as depicted in FIG. 3, which shows an exemplary comparator output when the piezo disk is repeatedly tapped. By specifying a sufficiently large N, and requiring all tap spacings to occur within a minimum and maximum time with respect to one another, it is believed that the probability of a false wake-up signal will be minimal. An exemplary algorithm 400 for recognizing the N taps is shown in the flow diagram of FIG. 4.

Figure 4:
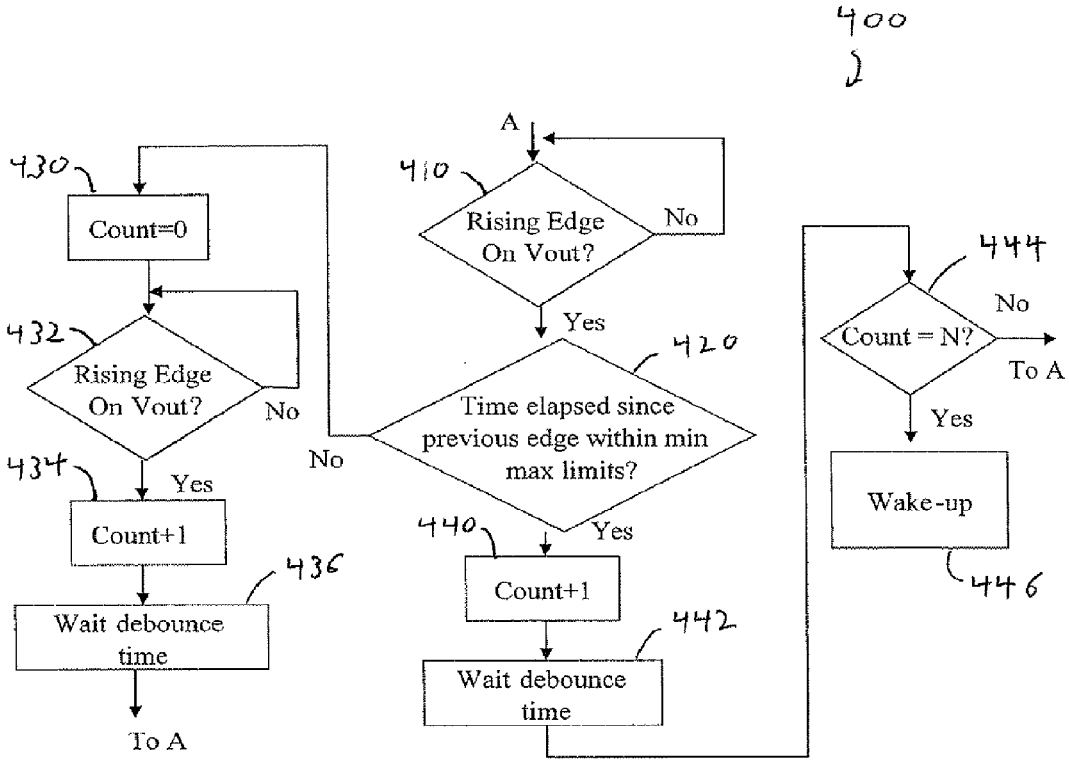
FIG. 4 is a flow diagram of an exemplary process for detecting a tap pattern.

With reference to FIG. 4, the method 400 includes at the start (point A), determining whether there is a rising edge on Vout (step 410). If no, then the method 400 returns to the start. If yes, then the method 400 proceeds to step 420, which involves determining whether the time elapsed since the previous edge is within the minimum and maximum limits.

If the time elapsed since the previous edge is not within the minimum and maximum limits, the method 400 proceeds to step 430, which involves setting the counter to zero. At step 432, the method 400 involves determining whether the rising edge is on Vout. If no, the method 400 returns to step 432; otherwise, the method 400 proceeds to step 434 where counter is increased or updated. After step 434, the method 400 involves waiting a debounce time period (step 436), after which the method 400 returns to the start.

If the time elapsed since the previous edge is within the minimum and maximum limits (step 420), then the method proceeds to step 440 where the counter is updated. Next, at step 442, the method 400 involves waiting the debounce time period. The method 400 then proceeds to step 444, which involves determining whether the count is equal to N. If yes, a wake-up signal is sent (step 446). It is note that the technique illustrated in the FIG. 4, may be coded into a microcontroller, or could also be implemented directly in hardware with simple circuits, such as, for example, counters and monostable multivibrators.

It is noted that a pump that implements a pressure pattern recognition circuit that implements the methodology outlined in FIG. 4 or variations thereof, provides a failsafe mode, wherein the patient/user may manually inject a dose of an agent (e.g., insulin) when he/she enters a pressure pattern that satisfies a predetermined condition (e.g., N successive taps). The pump may send a record of the injection/delivery to an associated PDA so that the patient may verify the dose and/or keep records of all injections. Information regarding all such administered doses may be recorded in a nonvolatile flash memory on the PDA and/or pump.

In accordance with another aspect of the embodiment described herein, a piezo transducer may be used for audible indication. If the transducer is driven with an applied voltage, it can act as a speaker and generate an audible tone. For example, if the frequency is chosen to match the resonant frequency of the piezo, the emission gain will be large, such that a loud tone can be generated without needing higher voltages than are commonly available. Accordingly, the piezo transducer may be used to generate an audible signal, in addition to acting as a button to enable waking up the device.

The audible signal can be used in many different ways. In a first example, after a tap pattern has been accepted and the device has been awakened, a short beep may be generated to indicate this to the user. In a second example, the pump may be put into suspend mode by, for example, tapping again after the first beep, within a defined time period (e.g. a few seconds). The piezo may then produce a pair of beeps to indicate the pump is in suspend mode (and optionally continue with short occasional beeps to warn the user that no pumping is occurring). A third tap sequence begun within a few seconds after the second could place the pump into manual mode—e.g., signaled with three beeps—to allow manually induced pump strokes initiated by each subsequent tap sequence, as discussed earlier. In a third example, the audible signal may warn the user that the pump failed to connect with the phone during its normal scheduled connection time. As an example, there could be three short tones after the first failure, six short tones after the second failure, and a continuous signal or tone after the third failure. Since a failure may occur when the PDA is out of range of the pump, then an audible signal generated by the PDA might not be heard by the user. As such, having a local alarm (i.e., an alarm generated by the pump) that is usually near the user is a prudent approach to warning the user of this failure mode.

In related aspects, there is provided a circuit implementation for using a piezo as a touch sensor and/or an audible indicator (i.e., an alarm). With reference to the circuit diagram shown in FIG. 5, there is provided a circuit 500 that places the piezo 510 into one of two modes (i.e. touch sensor mode or alarm mode) by controlling the state of the tri-state buffer 520 and the switch 530, which may be conveniently selected by a microcontroller.

When the piezo 510 operates as a touch sensor, the switch 530 is open, such that the input to inverter-i1 522 is connected to logic-1 532, which causes its output to be connected to ground with low impedance, grounding the bottom lead of the piezo 510. The tri-state buffer 520 is off (i.e., set to hi-Z). The voltage produced when pressure is applied to the piezo 510 is thus applied to high-impedance node VA, referenced to ground, and into the comparator 540.

When the piezo 510 operates as an alarm, the tri-state buffer 520 is activated, and the switch 530 is closed. Due to the extra inverters 524 and/or 526 along the top path, the oscillator 534 drives the top and bottom of the piezo 510 with opposite phases, thereby producing a differential drive to the piezo 510 and doubling the effective drive to the piezo 510.

In accordance with one aspect of the embodiments described herein, there is provided an apparatus/circuit for controlling a device having a touch sensor. For example, with reference to the embodiment of FIG. 5, the circuit 500 may comprise: a piezo transducer 510 for detecting a pressure pattern applied to the sensor; a comparator 540 coupled to the transducer 510 and a reference voltage or reference value generator; and a pressure pattern recognition circuit (not shown) coupled to a comparator output of the comparator 540. The pressure pattern recognition circuit/module may be configured to: (i) determine whether the pressure pattern satisfies a predetermined condition; and (ii) in response to the pressure pattern satisfying the predetermined condition, generate an output signal.

In related aspects, the pressure pattern recognition module may be configured to recognize and respond to a defined number of taps occurring in succession. For example, this module may be configured to: (a) detect a rising edge on a comparator output signal; (b) in response to detecting the rising the edge, determine whether a time period elapsed since a previously detected edge falls within minimum and maximum time limits; (c) in response to the elapsed time falling within the minimum and maximum time limits, (i) increase a tap count and (ii) wait a debounce time period; and (d) in response to the tap count equaling the defined number, waking up a component the apparatus.

In further related aspects, the module may be further configured to: (e) in response to the elapsed time falling outside the minimum and maximum time limits, set the tap count to zero; (f) detect a subsequent rising edge on the comparator output signal; and (g) in response to detecting the subsequent rising the edge, (i) increase the tap count, (ii) wait the debounce time period, and (iii) return to step (a).

Figure 5:
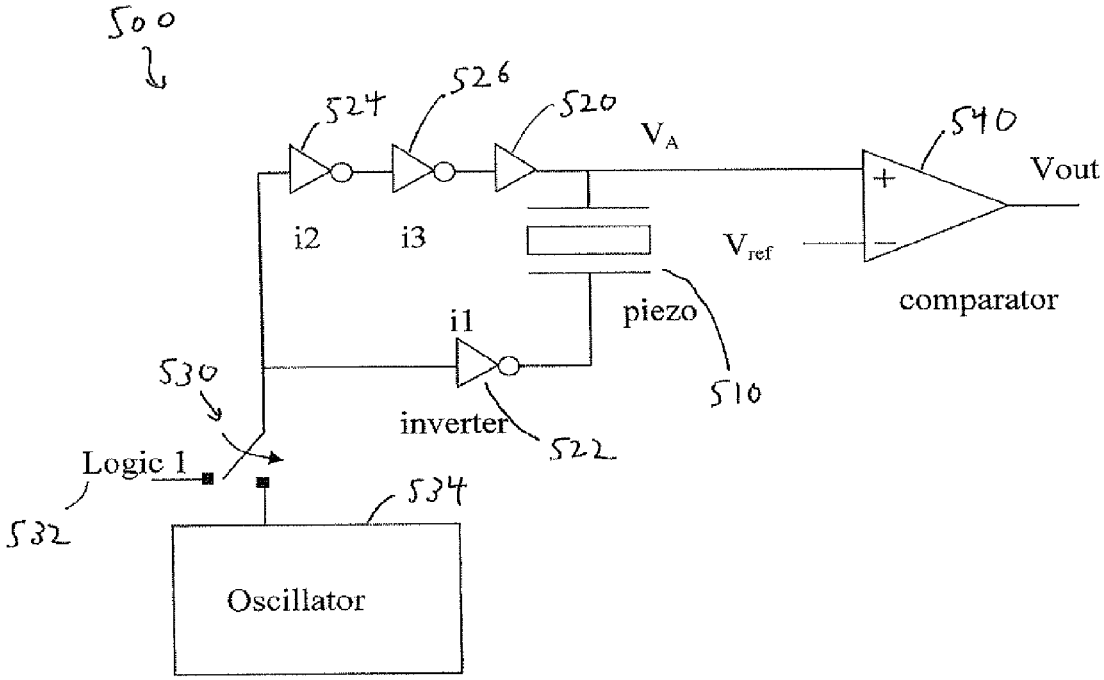
FIG. 5 shows one embodiment of an apparatus for controlling a device having a touch sensor.

In accordance with another aspect of the embodiments described herein, with continued reference to FIG. 5, the circuit 500 may further comprise a switch 530 coupled to and selectively connecting the transducer 510 to at least one of (i) a logic circuit 532 and (ii) an oscillator 534. The transducer 510 may operate as a pressure pattern detector in response to being connected to the logic circuit 532 and/or as an alarm generator in response to being connected to the oscillator 534.

In related aspects, the logic circuit 532 provides a signal value corresponding to a logic value, thereby grounding a bottom lead of the transducer 510; and/or the oscillator 534 provides an oscillating signal, thereby increasing a drive voltage to the transducer 510.

In further related aspects, an inverter 522 may connected between the switch 530 and a bottom lead of the transducer 510, wherein the inverter 522 is configured to transmit a ground signal to the transducer 510 to permit the transducer 510 to operate as the pressure pattern detector, and wherein the inverter 522 is configured to transmit an oscillating signal to the transducer 510 to permit the transducer 510 to operate as the alarm generator.

In yet further related aspects, the circuit 500 may further comprise a tri-state buffer 520 coupled to a top lead of the transducer 510. In response to the buffer 520 being set to a high impedance state, the transducer 510 is permitted to operate as the pressure pattern detector. In response to the buffer 520 being set to a low impedance state, the transducer 510 is permitted to operate as the alarm generator. The oscillator 534 may drive the top and bottom leads of the transducer 510 with opposite phases, thereby doubling an effective drive of the transducer 510.

In accordance with another yet aspect of the embodiments described herein, there is provided a method for controlling a device having a touch sensor. The method may involve: sensing a pressure pattern applied to a sensor; and determining whether the pressure pattern satisfies a predetermined condition. The method may further involve, in response to the pressure pattern satisfying the predetermined condition, generating an output signal; and controlling the device via the output signal. The method may further involve generating an alarm based on the output signal, wherein the alarm is generated using a transducer coupled to the sensor.

One of ordinary skill in the art would understand that the functions performed by one or more of the various other components shown in the circuits described herein may performed by a suitable microcontroller. For example, one of ordinary skill in the art would understand that the inverters, the comparator, and/or the switches or tri-state buffer(s) could be implemented with a suitable microcontroller. For example, a suitable microcontroller connection to the piezo actuator could be configured to provide a low impedance driver when the piezo actuator was intended to act as an alarm, and a high impedance input to an internal comparator when the piezo actuator was intended to act as a sensor.

One of ordinary skill in the art also would understand that many of the discrete components described herein may be implemented in one or more application specific integrated circuits (ASICs). One of ordinary skill in the art also would understand that an ASIC could perform several, most or all of the tasks of the microcontroller. Such an implementation could be controlled by an external microcontroller or the like.

Furthermore, one of ordinary skill in the art would understand that a microcontroller and its functions may be implemented within one or more ASICs, digital signal processors (DSPs), digital signal processing devices (DSPDs), programmable logic devices (PLDs), field programmable gate arrays (FPGAs), processors, controllers, microcontrollers, microprocessors, electronic devices, other electronic units designed to perform the functions described herein, or a combination thereof.

While the present invention has been illustrated and described with particularity in terms of preferred embodiments, it should be understood that no limitation of the scope of the invention is intended thereby. Features of any of the foregoing methods and devices may be substituted or added into the others, as will be apparent to those of skill in the art. It should also be understood that variations of the particular embodiments described herein incorporating the principles of the present invention will occur to those of ordinary skill in the art and yet be within the scope of the invention.

The invention claimed is:

1. An apparatus for controlling a device having a touch sensor, comprising:
- a piezo transducer for detecting a pressure pattern applied to the sensor;
- a comparator coupled to the transducer; and
- a pressure pattern recognition circuit coupled to a comparator output of the comparator, the circuit being configured to:
- determine whether the pressure pattern satisfies a predetermined condition; and
  - in response to the pressure pattern satisfying the predetermined condition, generate an output signal;
- a switch coupled to and selectively connecting the transducer to one of (i) a logic circuit and (ii) an oscillator, wherein:
  - the transducer operates as a pressure pattern detector in response to being connected to the logic circuit, wherein the logic circuit provides a signal value corresponding to a logic value, thereby grounding a bottom lead of the transducer; and the oscillator provides an oscillating signal, thereby increasing a drive voltage to the transducer; and
  - the transducer operates as an alarm generator in response to being connected to the oscillator;
- an inverter connected between the switch and a bottom lead of the transducer, wherein:
  - the inverter is configured to transmit a ground signal to the transducer to permit the transducer to operate as the pressure pattern detector; and
  - the inverter is configured to transmit an oscillating signal to the transducer to permit the transducer to operate as the alarm generator;
- a tri-state buffer coupled to a top lead of the transducer, wherein:
  - in response to the tri-state buffer being set to a high impedance state, the transducer is permitted to operate as the pressure pattern detector; and
  - in response to the tri-state buffer being set to a low impedance state, the transducer is permitted to operate as the alarm generator.

2. The apparatus of claim 1, wherein the circuit is configured to recognize and respond to a defined number of taps occurring in succession.

3. The apparatus of claim 2, wherein the circuit is configured to:
- (a) detect a rising edge on a comparator output signal;
- (b) in response to detecting the rising the edge, determine whether a time period elapsed since a previously detected edge falls within minimum and maximum time limits;
- (c) in response to the elapsed time falling within the minimum and maximum time limits, (i) increase a tap count and (ii) wait a debounce time period; and
- (d) in response to the tap count equaling the defined number, waking up a component the apparatus.

4. The apparatus of claim 3, wherein the circuit is further configured to:

(e) in response to the elapsed time falling outside the minimum and maximum time limits, set the tap count to zero;

(f) detect a subsequent rising edge on the comparator output signal; and (g) in response to detecting the subsequent rising the edge, (i) increase the tap count, (ii) wait the debounce time period, and (iii) return to step (a).

5. The apparatus of claim 1, wherein the oscillator drives the top and bottom leads of the transducer with opposite phases, thereby doubling an effective drive of the transducer.

* * * * *